US005333381A

United States Patent [19]

Gelardi et al.

[11] Patent Number: 5,333,381

[45] Date of Patent: Aug. 2, 1994

[54] WRAP CUTTER

[75] Inventors: Paul J. Gelardi, P.O. Box 127, Cape Porpoise, Me. 04014; David A. Capotosto, Kennebunk; James R. Dussault, Kennebunkport, both of Me.; Christopher C. Capotostop, East Greenwich, R.I.

[73] Assignee: Paul J. Gelardi, Kennebunkport, Me.

[21] Appl. No.: 964,000

[22] Filed: Oct. 21, 1992

[51] Int. Cl.[5] ..... B67B 7/00; B26B 29/06

[52] U.S. Cl. ..... 30/2; 30/294

[58] Field of Search ..... 30/2, 246, 260, 280, 30/294, 299, 346.59, 346.41

[56] References Cited

U.S. PATENT DOCUMENTS

| | | | |
|---|---|---|---|
| 1,129,310 | 2/1915 | Platt | 30/2 |
| 1,795,527 | 3/1931 | Tyreman . | |
| 1,796,870 | 3/1931 | Huhn et al. . | |
| 2,068,020 | 1/1937 | Grounds | 30/2 |
| 2,204,267 | 6/1940 | Wyres | 30/2 |
| 2,247,290 | 6/1941 | Disbrow | 30/2 |
| 2,896,318 | 7/1959 | Brown | 30/2 |
| 3,509,625 | 5/1970 | Bajulaz | 30/280 |
| 3,644,993 | 2/1972 | Chupp . | |
| 4,467,524 | 8/1984 | Ruff et al. . | |
| 4,501,069 | 2/1985 | Sagamihara | 30/294 X |

OTHER PUBLICATIONS

*Flexure Devices*–by Machon Products Company of Toledo (publication date unknown).

*Primary Examiner*—Richard K. Seidel
*Assistant Examiner*—Paul M. Heyrana
*Attorney, Agent, or Firm*—James Creighton Wray

[57] ABSTRACT

A cutter for removing overwraps or tape on products and product packages incorporates first and second wings extending angularly from a body. A cutting point extends a short distance into the angle between the wings, wherein the wings embrace an edge of a product and the blade slices the wrapper along the edge as the user slides the cutter along the edge. The wings are flexible to conform to the angle of the edge, and are integrally molded with the body. Living hinges provided between the wings and the body, or the wings are molded angularly with respect to the body. A cutter is molded as a flat blank and folded. A solid article is molded with a pocket for insertion of the blade. The angle between the wings is less than or equal to 90°, allowing it to conform to most standard packages. The reduced angle between the wings and the relatively slight exposure of the blade allows for effective cutting of the wrapper without scarring the package or injuring the user.

15 Claims, 5 Drawing Sheets

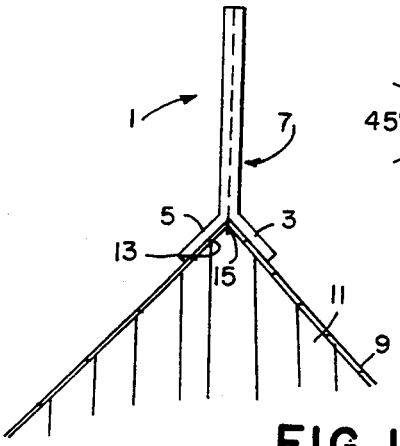
FIG. 1
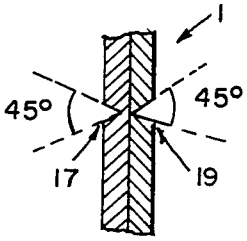
FIG. 2A
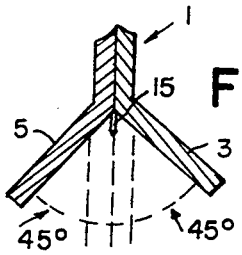
FIG. 2B
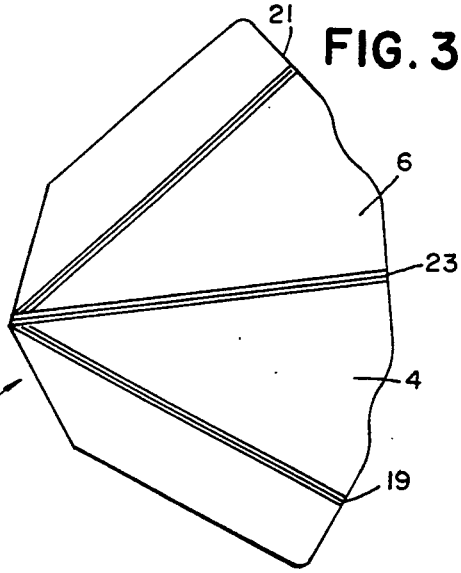
FIG. 3B
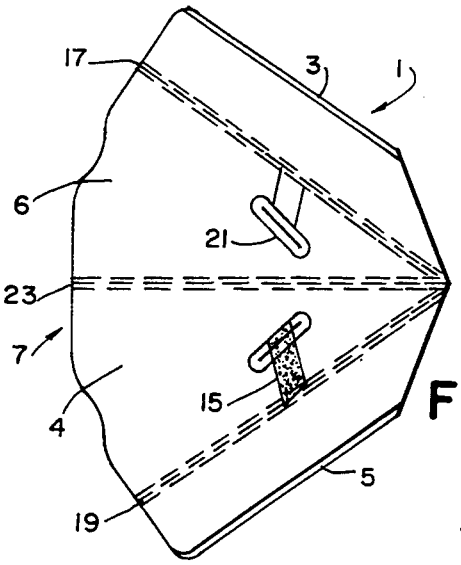
FIG. 3A
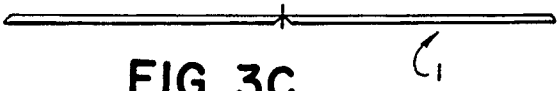
FIG. 3C
FIG. 3D
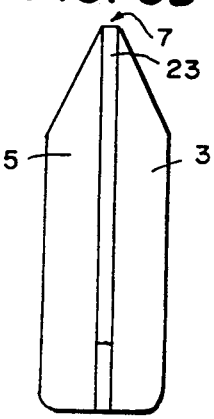
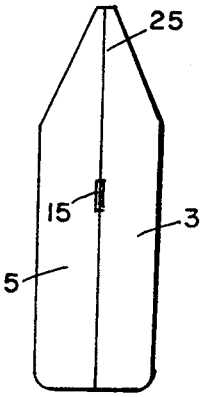
FIG. 3E
FIG. 3F
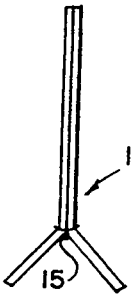
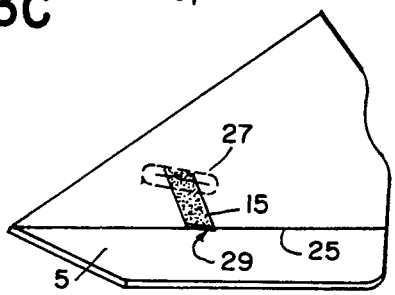
FIG. 4
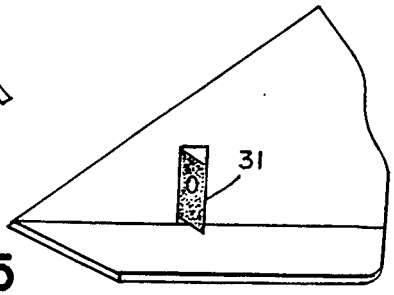
FIG. 5

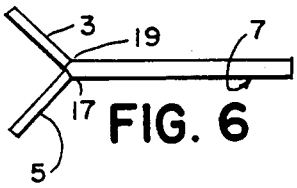
FIG. 6
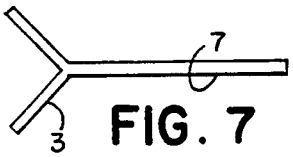
FIG. 7
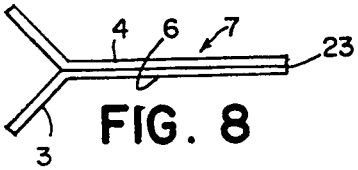
FIG. 8
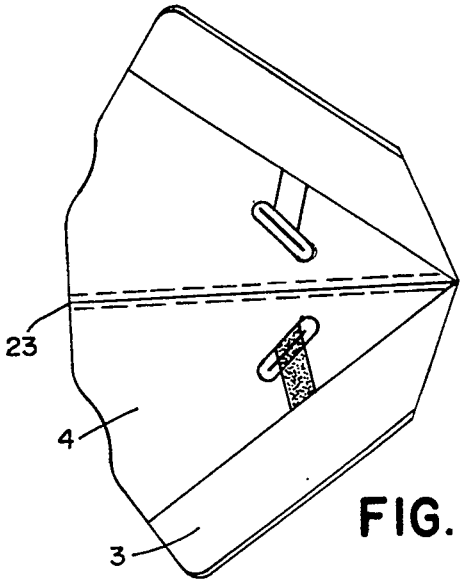
FIG. 9
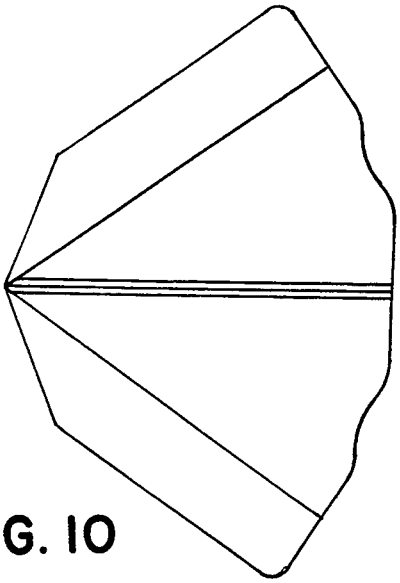
FIG. 10
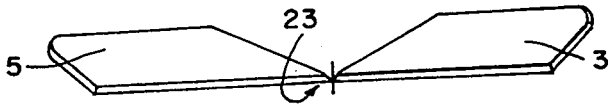
FIG. 11
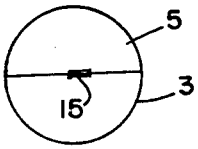
FIG. 12A
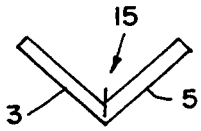
FIG. 12B
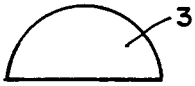
FIG. 12C
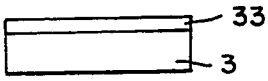
FIG. 13C
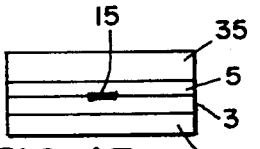
FIG. 13A
FIG. 13B
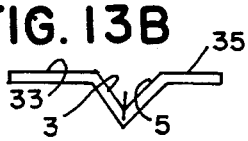
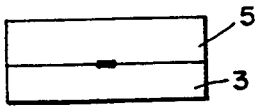
FIG. 14A
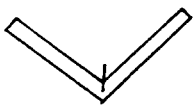
FIG. 14B
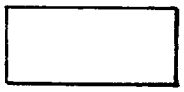
FIG. 14C

WRAP CUTTER

BACKGROUND OF THE INVENTION

The present invention relates to removal of wraps from packages or tape along the edge of a package. Specifically, a preferred embodiment relates to removal of plastic film shrink wrap from packages such as compact disks, LP covers and video cassette boxes.

Compact disks, video and audio tapes and LPs are typically packaged with shrink wrap outer coverings. Because the wrap adheres tightly to the inner package, it is difficult to remove. Sharp instruments are used to scratch and tear the surface to provide a handhold for removal of the wrap. However, these sharp instruments often scratch the surface of the package underneath, as well as presenting a danger to the user. There exists a need for a safe means of removing plastic overwraps from such packages which will not damage the package.

Prior art means for removing plastic overwraps, for removing tape from package boxes, and for cutting the edges of a package include the use of a knife and/or razor blades, some of which incorporate some type of sheathing mechanism to protect the user's hands. These implements are usually made of metal and incorporate screws and other moving parts which increase costs and complication of manufacture. Further, most of these implements do not adequately protect the user's hands. There exists a need for an inexpensive wrap cutter of relatively simple design.

SUMMARY OF THE INVENTION

In a preferred embodiment, the wrap cutter is a small blade which bisects and extends partially into an angular space between two wings. The angle between the wings is preferably less than 90°, with the angles between the blade and the first and second wings being less than 45°. The angled cutter embraces a squared edge of a wrapped article with the blade cutting the edge as it slides along the rim of the article. The cutter has a small embedded blade or abrasive edge which extends from a pocket in a handle a short distance between two angular guides. In one embodiment, the cutter is folded from a single blank with three angularly related notches. The middle notch forms the top of the double layered handle. The outer notches join the handle and the wrap. The outer notches may be living hinges which allow the flaps to spread in use, or the angled wings may be molded in angular relation to the handle panels.

The present invention fulfills the need for a cutter which can cut the overwraps without noticeably damaging the product and without the risk of cutting oneself.

The cutter cuts along the 90° edge of boxes in order to make the cutter have universal application using the product edge as a natural cutting guide. The cutter blade is positioned at an angle so that any marking of the box "disappears" into the 90° corner. By angling the blade in such a manner that it fits in the crotch of a pair of guides, or wings, and having the blade protrude only a short distance into the angle, the blade can cut the wrapping but not cut the user's finger.

The corner guides can be either fixed or hinged wings. The angle between the fixed wing version preferably is less than or equal to approximately 90°. Incorporating an angle larger than 90° would reduce the effective guidance and increase exposure of the blade. The angle smaller than 90° used in the present invention requires that the structure of the device allow the wings to flex to the angle of the corner of the box being cut. This concept can be used on any angled edge, with the angle between the wings to be specified during manufacture. The hinged wing version allows for the cutter to be shipped flat, or to be packaged with the product to be opened for use as a premium.

The device can be made in a wide number of shapes. The shapes can be designed to mimic the shapes of product categories that the cutter is used with, such as a video cassette, CD, or audio cassette.

In one embodiment the device is molded flat and subsequently folded around a blade. Alternatively, it can be molded into its final shape and the blade inserted into a blind pocket. The blade can also be incorporated into enclosed structures.

The blade can be a knife blade, an abrasive point, a "pizza cutter" blade or any object which can cut the wrap.

In the hinged wing version of the present invention, if the angle leading into the hinge is on the side that the wing hinges toward, the lead-in angle will act as a natural stop so as to fix the open position as desired. For instance, if an open position of approximately 90° between the wings is desired, each wing would hinge 45°. A lead-in angle to each hinge of 45° will allow each wing to open 45° (for a total of 90°), creating a natural stop.

These and further and other objects and features of the invention are apparent in the disclosure, which includes the above and ongoing written specification, with the claims and the drawings.

BRIEF DESCRIPTION OF THE DRAWINGS

FIG. 1 is a cutaway side view of the cutter with the flexible arms embracing the edge of the wrapped article and the blade entering the wrapping at the corner.

FIG. 2A shows the molded cutter having integrally molded hinges with 45° divots which prevent extension of the wings beyond 90°.

FIG. 2B is a cutaway side view showing the flexible wings in the open position, each angled 45° from the blade.

FIG. 3A shows an unfolded bottom view of the molded blank having hinged wings and handle panels with a blade pocket for insertion of a blade.

FIG. 3B shows the top view of the blank shown in FIG. 3A.

FIG. 3C is a front view of the blank showing the thickness of the molded cutter.

FIG. 3D is a top view showing the angled wings on either side of the vertical handle.

FIG. 3E is a bottom view showing the angled wings extending outward from the central blade.

FIG. 3F is a front view showing the folded cutter and angled wings.

FIG. 4 is a side view of one molded cutter showing the placement of the blade extending slightly below the line of convergence of the wings.

FIG. 5 shows an alternative placement of the blade.

FIG. 6 is a front view showing a solid molded handle and hinged wings.

FIG. 7 is a front view showing wings molded angularly from a solid handle.

FIG. 8 is a front view of wings molded angularly from a folded handle.

FIG. 9 is a bottom view of a preferred embodiment having wings fixed during molding and a center hinge for holding of the handle.

FIG. 10 is a top view of the embodiment shown in FIG. 9.

FIG. 11 is a rear view of the embodiment shown in FIG. 9, showing wings extending upwards at an angle.

FIGS. 12A, 12B and 12C show bottom, front and side views a molded spherical cutter.

FIGS. 13A, 13B and 13C show bottom, front and side views of an embodiment with flanges extending horizontally from the wings.

FIGS. 14A, 14B and 14C are bottom, front and side views of an elongated triangular cutter.

DETAILED DESCRIPTION OF THE DRAWINGS

Figure 15A:
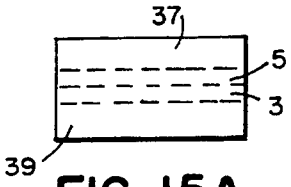
FIGS. 15A, 15B and 15C show bottom, front and side views of a hollow cutter structure.

The wrap cutter of the present invention is generally indicated by the numeral 1 in FIG. 1. The preferred cutter incorporates first and second flexible wings 3 and 5, which converge at a handle or holder 7. A blade 15 extends out of the handle 7 into an angle provided between the flexible wings. In a preferred embodiment, the blade bisects the angle prescribed by the wings.

Preferably the wings 3 and 5 embrace the edge 13 of a package or other such article 11 which is wrapped with a wrap 9 tightly attached thereto. Such wraps are commonly found on packaged CDs and cassettes, and are known as shrink wraps. The user runs the cutter along an edge with the blade 15 piercing the wrap 9 as the wings embrace the edge. Preferably, the wings form an angle which is less than the angle as prescribed by the edge 13. The wings embrace and conform to the edge as the user pushes down on the handle 7 and runs the cutter along the edge.

Reduced angles between the wings decreases the chances that a user's finger will enter between the wings and be cut by the exposed blade. Further, the blade of the present invention only extends partially into the angle at a distance which is great enough to cut through the thin wrapper, but which is not great enough to harm the user or to scar the package underneath.

As shown in FIGS. 2A and 2B, a preferred cutter incorporates flexible wings 3 and 5, which are hinged to the handle 7 by means of living hinges 17 and 19. In a preferred embodiment, the cutter of the present invention is formed of a moldable material and is molded. The hinges 17 and 19, and further the moldable material, provide elasticity to the wings. The hinges 17 and 19 are shown as divots which have 45° cuts. The cuts allow for rotation of the wings 3 and 5 to expose the blade 15, but restrict the extension of the wings beyond 45° with respect to the blade because of the abutment of the two sides of the divot, as shown in FIG. 2B.

In a preferred embodiment as shown in FIGS. 3A–3F, the invention is molded as a flat blank having plural hinges which define panels. Outer wing hinges 17 and 19 delineate outer wings 3 and 5 from inner first and second handle panels 4 and 6. A central handle hinge 23 provides a means for folding the mirrored inner panels 4 and 6, which are then attached to each other to form the handle 7. The wings 3 and 5 are angled outwards therefrom. A blade attachment means 21 can be a fitted pocket, as shown in FIG. 3A, to facilitate placement of the blade. FIG. 3B shows a top view with the blade held interiorly and unexposed. FIG. 3C shows a front view providing the thickness of the blank. As can be seen, the invention can be constructed of materials which are limited to the moldable material and the material for the blade, therefore cutting costs in manufacture.

The bottom of the folded structure in shown in FIGS. 3D, 3E and 3F. From the top, in FIG. 3D, the handle 7 is shown by the folded panels at hinge 23, with the wings 5 and 3 angled downwards and outwards therefrom. In FIG. 3E the wings 5 and 3 angle towards a line of convergence 25 provided by the two hinges, with the blade 15 extending therethrough. FIG. 3F shows a profile with the blade 15 barely extending beyond the line of convergence for protection of the user and the package.

FIGS. 4 and 5 show two means for engagement of the blade within the cutter. In FIG. 4, a pocket 27 accommodates the blade 15 in such a manner that the blade edge 29 barely extends beyond the line of convergence 25 of the wings and into the angle as prescribed thereby.

Figure 5A:
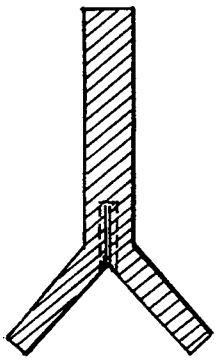
FIG. 5A shows a solid molded handle with a molded pocket for insertion of the blade.

FIG. 5 shows an alternative engagement means, wherein the blade incorporates a hole to be mated with a detent 31 which is molded or formed in one of the panels. FIG. 5A shows a solid handle with angularly molded wings and a pocket molded for insertion of the blade. The blade may also be molded with the cutter. Any suitable engagement means for the blade so that it extends within the angle between the wings is within the scope of the present invention.

FIGS. 6, 7 and 8 show three preferred embodiments of the present invention. In FIG. 6 the handle 7 is molded as a solid construction, and the wings 3 and 5 revolve around hinges 17 and 19 molded into the cutter to provide the angle therebetween.

In FIG. 7, wing 3 is molded at an angle from the solidly molded handle 7, with the material of manufacture providing the flexibility needed for embracing an edge.

FIG. 8 also shows the wing 3 molded to the handle 7 at an angle. However, the hinge 23 separates the two panels 6 and 4 of the handle 7, and the cutter is molded as a blank having a central hinge 23 and two upwardly extending wings. Upon folding at hinge 23, the panels mate and the wings join to form an angle therebetween, which is preferably less than or equal to 90°.

The central handle hinge 23 and angularly molded wings attached to the panels are shown in greater detail in FIGS. 9, 10 and 11. FIG. 9 shows the wings prior to folding, with the blade exposed and partially extending beyond the edge of the panel 4.

FIG. 10 is a top view showing the panels and wings prior to folding.

FIG. 11 is a front view showing the upwardly extending wings 5 and 3, and the central hinge 23, prior to folding.

FIGS. 12A, 12B and 12C show an alternate molded cutter which is molded in a spherical shape. In this case, the user would grasp the wings 3 and 5 and use the wings as a handle, with the blade 15 extending partially into the point of convergence.

FIGS. 13A, 13B and 13C provide an elongated triangular structure having flanges 33 and 35 extending horizontally away from the wings 3 and 5. The flanges 33 and 35 provide a broader area for grasping the cutter.

FIGS. 14A, 14B and 14C show a simple elongated triangular structure, wherein the user grasps the wings 3 and 5 and slides the cutter along the edge of the article to be de-wrapped. Such structures can be made inexpensively because of the simplicity of manufacture and the limited materials needed for manufacture.

Figure 15B:
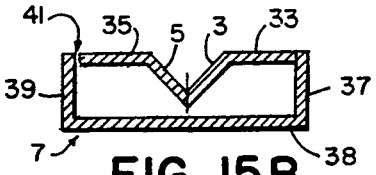
Figure 15C:
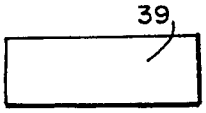

FIGS. 15A, 15B and 15C show a hollow enclosure which can be molded as a blank and folded along plural hinges to provide more grasping area and added protection. Such a structure may also be used to simulate the article upon which it may be used, such as a square CD having graphics printed on the handle 7 at some point. If molded as a blank, a first flange 35 is molded with the first wing 5, and a second flange 33 is molded with the second wing 3. A first side 33, top face 38 and second side 39 of the handle 7 are similarly hinged and molded to one of the flanges and are connected at connection means 41 to the outer flange.

Figure 16A:
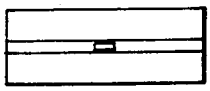
FIGS. 16A, 16B and 16C show bottom, front and side views of a cutter having three elongated members, which are the wings and the handle.
Figure 16B:
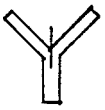
Figure 16C:
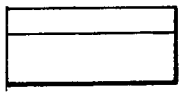

FIGS. 16A, 16B and 16C show a cutter having three elongated members which are approximately the same length from the embedded blade. The simplicity of this structure is advantageous, and a slot or aperture can be provided on the underside between the wings for insertion of a blade.

Figure 17A:
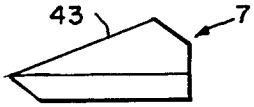
FIGS. 17A, 17B and 17C are side, front and bottom views of a ramped handle and wing embodiment.
Figure 17B:
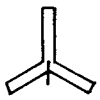
Figure 17C:
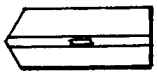

FIGS. 17A, 17B and 17C show a molded cutter similar to that shown in FIGS. 16A, 16B and 16C, wherein a ramped handle 43 is provided, but does not take away from the simplicity of manufacture.

Figure 18:
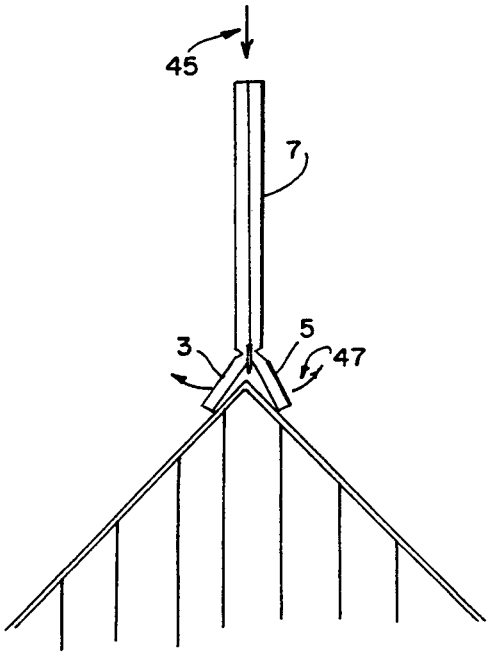
FIGS. 18 and 19 show the action of opening the wings to an angle as prescribed by the edge of the box through pushing of the handle downward with the wings rotating outwards.
Figure 19:
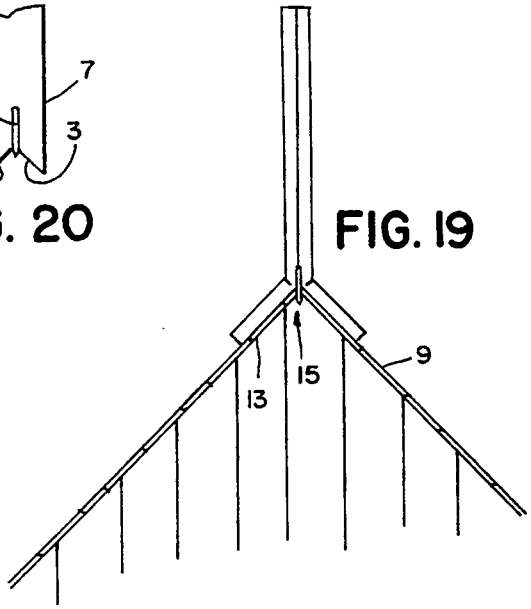

FIGS. 18 and 19 show the action of embracing the edge 13 of the packaged article with the flexible wings 3 and 5. The user pushes down on the handle 7 as per arrow 45, which forces the wings 3 and 5 open as shown by arrows 47, piercing the wrap 9 with the blade 15. The user then runs the cutter horizontally in line with the edge to separate the wrap at that point. Because of the angle of the blade at 45° with respect to the faces of the packages, scoring of the package with the blade cannot be readily seen from either face.

Figure 20:
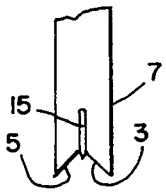
FIG. 20 shows a side view of an alternative cutter having flattened sides with a pocket molded near an end divot which prescribes the wings.

FIG. 20 shows an alternative view of the present invention, wherein the handle 7 and wings 3 and 5 are molded together as a plate-like article having flattened sides and a divot at the end for providing the 90° or less angle. A pocket is molded into the cutter proximal the divot.

FIGS. 21–26 relate to bi-directional cutting with a single edge blade.

Figure 24:
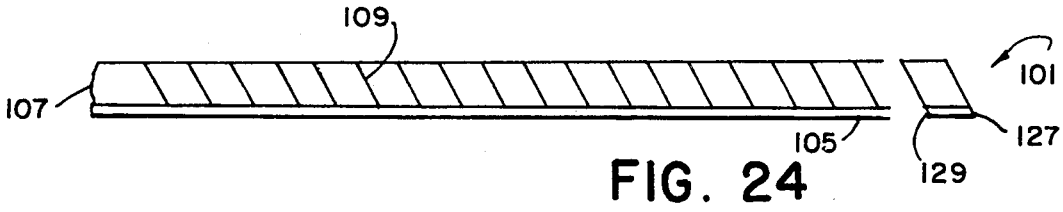
Figure 25:
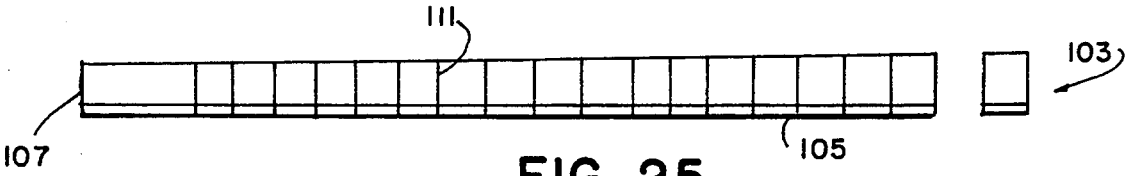

The least expensive type of blade to use in the wrap cutter is a breakoff blade 101 or 103, as shown in FIGS. 24 and 25, which is manufactured by grinding a cutting edge 105 on at least one side of a continuous strip 107 of material and then notching 109, 111 the blade at intervals. The blade 101 or 103 is then broken off at the notch 109 or 111.

Figure 21:
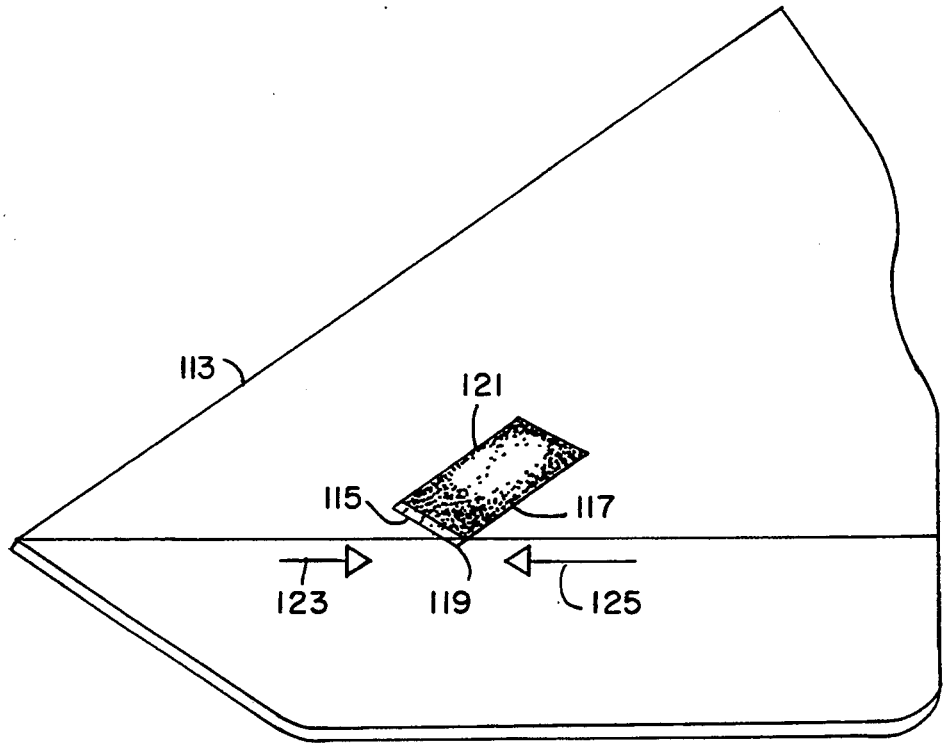
FIGS. 21 to 26 show breakoff blades and preferred mountings.

A blade is set in a handle 113, as shown in FIG. 21, and one edge 115 or 117 is used as the cutting point 119. If the point were set with the breakoff edge 117 at a sharp angle to the cutting direction, the blade and the cutting edge at a lesser angle, the blade would cut cleanly only in the one direction.

Bi-directional cutting is facilitated by use of either a curved edge or dual cutting edges. Both of those methods add dramatically to the cost of a blade.

Figure 22:
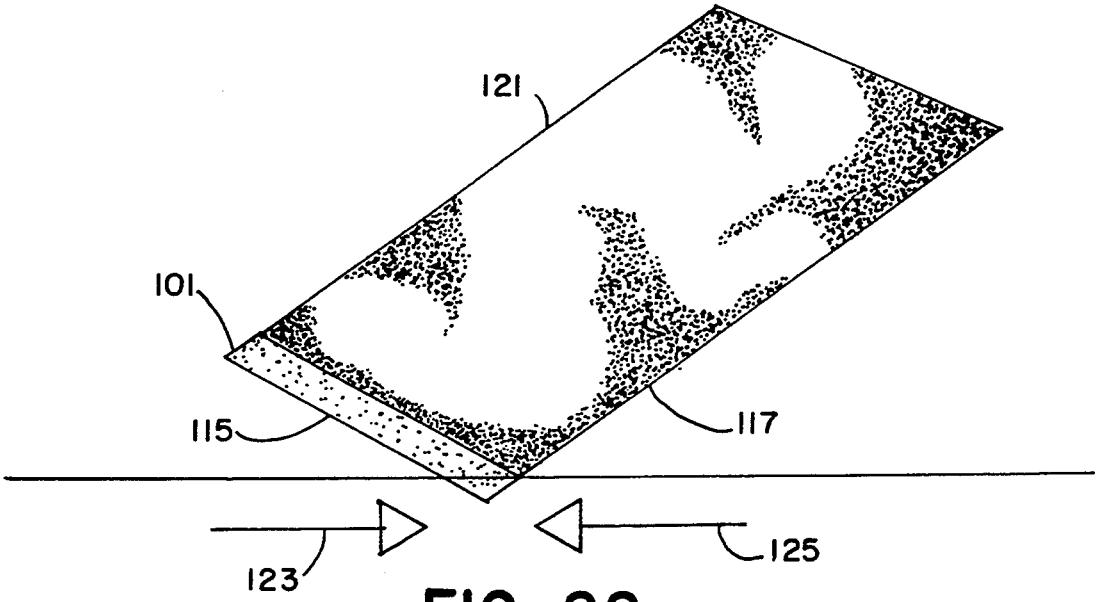
Figure 23:
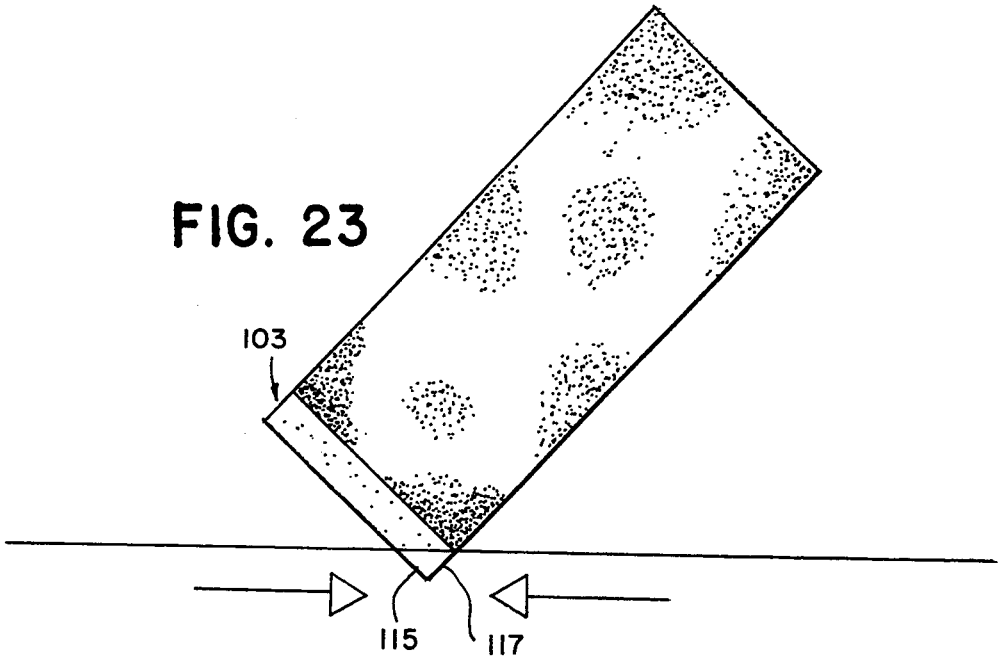
Figure 26:
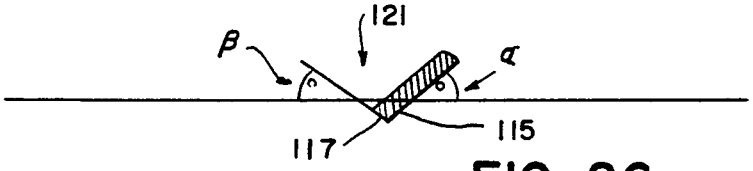

A blade 121 is positioned, as shown in FIGS. 21, 22 and 26, by setting the blade so that the angle $\alpha$ of the cutting edge 115 and angle $\beta$ breakoff edge 117 are approximately equal and are less than 90°. The blade 121 will cut in both directions 123 and 125, as shown in FIGS. 21, 22 and 23.

A breakoff blade 101 is made with an angled notch 109 greater than or less than 90°. The blade has a toe 127 (less than 90°) and a heel 129 (greater than 90°), as shown in FIG. 24. By using the heel 129 of the blade as the point 119, as opposed to the toe (as normally would be used), and by setting the angle of the point so that the cutting edge and breakoff edge of the blade are approximately equal angles to the cutting direction of the blade, the blade will cut more cleanly in both directions than if set with the toe as the point. The greater the angle of the point, i.e. the less the angle of attack of the point to the material being cut, the cleaner the cut will be.

The thinner the blade, also the cleaner the cut in both directions.

Minimizing the blade penetration also aids in bi-directional cutting with a single edge blade.

A preferred molded cutter is molded of a material such as polypropylene, which retains its elasticity through repeated use. Preferred blades are small metal razors or abrasive points. Pizza cutter-type blades having a small dowel provided within the handle and rotatable with an edge extending out between the wings into the angle are within the scope of the present invention.

Because most boxes and other wrapped articles have right angle edges, a preferred angle between the wings is less than or equal to 90°. However, the angle between the wings can be molded or specified during manufacture, according to the articles to be de-wrapped. The flexibility of the material and the nature of the hinges can provide a cutter which has an angular range, which is not found in the prior art.

While the invention has been described with reference to specific embodiments, modifications and variations of the invention may be constructed without departing from the scope of the invention, which is defined in the following claims.

We claim:

1. A wrap cutter apparatus comprising a pair of first and second collapsible wings transportable in a flat condition to hide a cutting blade held within the wings, the wings converging at an angular relationship to form a body when a pressure is applied on the apparatus, and the blade having a sharp portion which extends into an angle as prescribed by the first and second wings, wherein the wings embrace a corner edge of an article to be de-wrapped with the wings conforming to the angle of the edge when pressure is applied to the wings, the sharp portion of the blade extending into and cutting the wrap around the article at the edge as the cutter slides around the edge, wherein each wing is rotatable over a 45 degree angle with respect to the blade when the apparatus is pushed on the edge of the article to force open the wings, further wherein the wings and the body are integrally molded of a material which provides elasticity and resilience to the wings.

2. The apparatus of claim 1, further comprising the blade bisecting the angle as prescribed by the two wings.

3. The apparatus of claim 1, further comprising the angle between the wings being not more than 90°.

4. The apparatus of claim 3, further comprising the sharp portion bisecting the angle between the wings to thereby provide equal angles between the sharp portion and the first and second wings.

5. The apparatus of claim 1, further comprising the body being the line of convergence of the two wings, and a portion of this line encompasses the blade.

6. The apparatus of claim 5, further comprising the body incorporating a handle extending away from the angle and blade sharp portion.

7. The apparatus of claim 1, further comprising the cutter being molded as a flat blank having first and second outer panels and first and second inner panels, the first outer panel and first inner panel being mirror images of the second outer panel and second inner panel, a third hinge provided between the first inner panel and the second inner panel, the outer panels being the first and second wings and attached to the first and second inner panels opposite the third hinge, angling means provided between the wings and the inner panels for angling the wings with respect to each other when the inner panels are folded.

8. The apparatus of claim 7, further comprising the first and second inner panels being the body and having a mount for mounting the blade and positioning the blade, so that a sharp edge protrudes into the angle as prescribed between the two wings.

9. The apparatus of claim 8, further comprising the angling means being molded living hinges.

10. The apparatus of claim 8, wherein the mount positions the blade on an angle so that exposed leading the trailing edges of the blade form substantially equal angles with a line extending between the two wings.

11. The apparatus of claim 1, wherein the blade has an exposed point and exposed leading and trailing edges leading to the point, and wherein the leading and trailing edges are positioned at angles to a line between the wings for permitting cutting in either opposite direction of movement of the cutter along the article.

12. The apparatus of claim 11, wherein the leading edge is sharpened and wherein the leading and trailing edges are positioned at substantially equal angles to a line between the wings.

13. The apparatus of claim 12, wherein the blade is formed as a breakoff blade formed from a notched continuous strip having a ground edge for forming sharpened leading edges of breakoff blades.

14. A shrink wrap cutter apparatus transportable in a flat condition comprising a pair of first and second collapsible wings hiding a cutting element within the wings, the wings converging at an angular relationship for forming a body when a pressure is applied to the apparatus, the cutting element held within the body having a sharp portion which extends into the angle as prescribed by the first and second wings, wherein the wings embrace a corner of an article to be de-wrapped with the wings conforming to the angle of the corner when pressure is applied to the wings, the sharp portion of the blade extending into and cutting the wrap around the article at the corner as the cutter slides around the corner wherein each wings is rotatable over a 45 degree angle with respect to the blade when the apparatus is pushed in the corner of the article to force the wings to open.

15. A cutter apparatus transportable in a flat condition comprising a handle having flexible first and second wings converging at an angular relationship to form a body when a pressure is applied on the handle and a blade connected to the handle within the wings, each of the wings being rotatable over a 45 degree angle with respect to the blade when pressure is applied on the handle, wherein the blade is formed as a breakoff blade formed from a notched continuous strip having a ground edge for forming sharpened leading edges of breakoff blades, the continuous strip notches being at an angle to the ground edge for forming an acute angle toe and an obtuse angle heel with the ground edge at opposite corners of the breakoff blade, the blade being mounted in the handle with the heel exposed and adjacent portions of the edges forming an obtuse angle with a line of convergence of the wings, for cutting in either opposite direction of movement of the handle and exposed blade heel.

* * * * *